US005873987A

United States Patent [19]

Katayama et al.

[11] Patent Number: 5,873,987

[45] Date of Patent: Feb. 23, 1999

[54] REACTIVATION OF ACTIVE CATHODE

[75] Inventors: Shinji Katayama; Teruo Ichisaka, both of Tamano, Japan

[73] Assignee: Chlorine Engineers Corp., Tokyo, Japan

[21] Appl. No.: 908,614

[22] Filed: Aug. 7, 1997

[30] Foreign Application Priority Data

Aug. 7, 1996 [JP] Japan ..... 8-208070

[51] Int. Cl.[6] ..... C25B 11/00

[52] U.S. Cl. ..... 204/284; 204/280

[58] Field of Search ..... 204/284, 280

[56] References Cited

U.S. PATENT DOCUMENTS 5,100,525 3/1992 Pohto et al. ..... 204/284
5,454,925 10/1995 Garland et al. ..... 204/284
5,456,813 10/1995 Grange-Cossu et al. ..... 204/284
5,770,024 6/1998 Fabian et al. ..... 204/284
5,783,050 7/1998 Coin et al. ..... 204/284

FOREIGN PATENT DOCUMENTS 04056790 2/1992 European Pat. Off. .

*Primary Examiner*—Bruce F. Bell
*Attorney, Agent, or Firm*—Gottlieb, Rackman & Reisman, P.C.

[57] ABSTRACT

The invention provides a process for reactivating an active cathode attached to an electrolyzer, wherein a porous cathode that is attached to the electrolyzer by means of a flexible member and has a decreased electrode catalyst activity is provided thereon with a fresh active cathode equivalent to, or smaller in wire diameter or pore diameter than, the porous cathode by bending a mounting piece formed around said fresh active cathode without removal of a deteriorated electrode catalyst substance.

4 Claims, 2 Drawing Sheets

REACTIVATION OF ACTIVE CATHODE

BACKGROUND of the INVENTION

The present invention relates to a process of reactivating an active cathode, especially an active cathode used with an ion exchange membrane type electrolyzer.

For brine electrolysis, a cathode has been used, which is coated on its surface with an electrode catalyst material and has a lowered hydrogen generation overvoltage. However, the electrode catalyst material coating is freed of the electrode catalyst material or the catalytic action of the electrode catalyst material drops under the influences of impurities, etc. in a cathode solution while an electrolyzer is operated over long years, resulting in a hydrogen generation potential rise.

So far, various processes have been used to recover such a lowered activity of the electrode catalyst material coated on the cathode. For instance, (1) an electrode catalyst coating with a decreased activity is partly or wholly removed from the surface of a cathode attached to an electrolyzer body, and a fresh electrode catalyst is re-coated on the surface of a cathode substrate;

(2) a cathode substrate with a decreased cathode surface activity is removed from an electrolyzer, a fresh electrode catalyst material is re-coated on the surface of the cathode substrate, and the cathode substrate is attached to the electrolyzer; and (3) a first porous cathode substrate is detachably provided thereon with a second cathode substrate smaller in wire diameter than the first cathode substrate by way of a flexible or other member, and a catalytically active substance is coated on the second cathode substrate, so that when the activity of the catalytically active substance drops, the second cathode substrate is reactivated upon being removed from the first cathode substrate.

However, a problem with process (1) is that when the cathode is reactivated in remote facilities while it remains attached to the electrolyzer, the electrolyzer must be shut down over an extended period because of the need of long transportation times, etc.

A problem with process (2) is that it is required to remove from the electrolyzer body the cathode substrate that is generally welded thereto. In other words, the removal of the cathode substrate from the electrolyzer body, the attachment to the electrolyzer body of the cathode substrate with a fresh cathodically active substance re-coated thereon, and other operations must be performed at exclusive facilities.

An electrolyzer to which process (3) can be applied is constructed from an electrically conductive, porous electrode or cathode substrate and an electrode made up of a fine substrate of small diameter, which is attached to the porous electrode substrate by way of a flexible or spongy member. In such an electrolyzer, electrolysis takes place while the electrode is in close contact with an ion exchange membrane, and electrically conductive connection is made between the electrode and the porous electrode substrate by bringing the surface of the ion exchange membrane in contact with the surface of the electrode with a given contact surface pressure. Thus, the ion exchange membrane should have a contact surface pressure enough to make such electrically conductive connection. For this reason the ion exchange membrane may possibly be injured by the fine electrode substrate, and gases produced during electrolysis stagnate between the electrode and the porous electrode substrate.

SUMMARY of the INVENTION

The present invention provides a process for reactivating an active cathode attached to an electrolyzer, wherein a porous cathode that is attached to the electrolyzer by means of a flexible member and has a decreased electrode catalyst activity provided thereon with a fresh active cathode equivalent to, or smaller in wire diameter or pore diameter than, said porous cathode by bending a mounting piece formed around said fresh active cathode without removal of an electrode catalyst substance from said porous cathode that is deteriorated.

DESCRIPTION OF THE PREFERRED EMBODIMENT

The present invention will now be explained with reference to the accompanying drawings.

Figure 1:
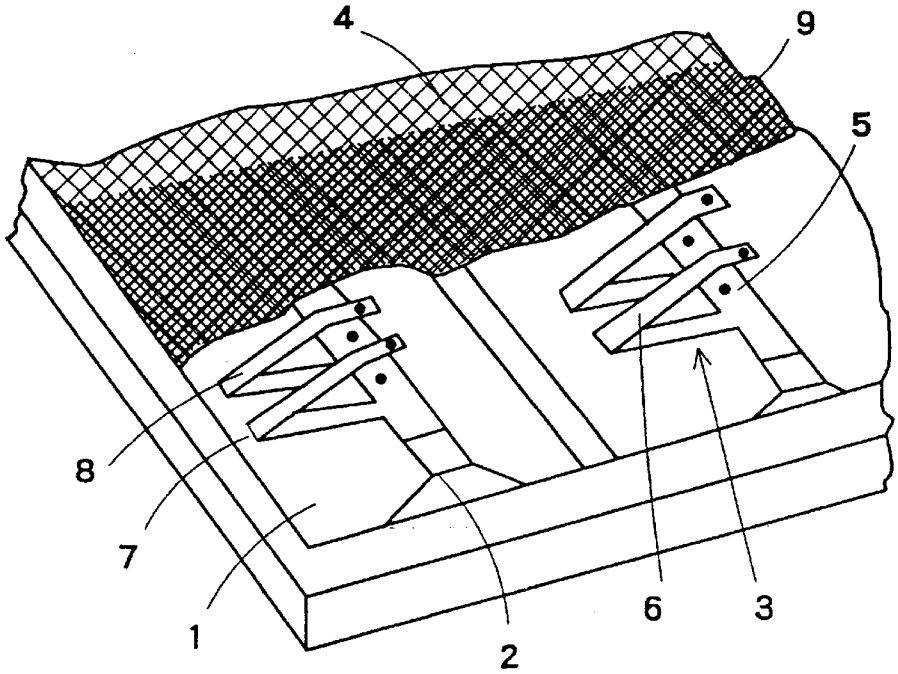
FIG. 1 is a partly cut-away perspective schematic illustrating a unit electrolyzer having an active cathode regenerated by the process of the present invention.

FIG. 1 is a partly cut-away perspective schematic illustrating a unit electrolyzer having an active cathode regenerated by the process of the present invention. Using a comb type of flexible member 3, a porous cathode 4 is attached to convex portions 2 of a corrugated thin partition wall in a unit electrolyzer 1. Also attached to the convex portions 2 are joints 5 of the comb form of flexible member 3. Each tooth 6 of the comb is bent back at a bending position 7, so that its extreme end 8 is welded or otherwise fixed to the porous cathode. In addition, an active cathode 9 smaller in wire diameter and mesh size than the porous cathode is attached on the porous cathode which is to undergo deterioration.

Figure 2:
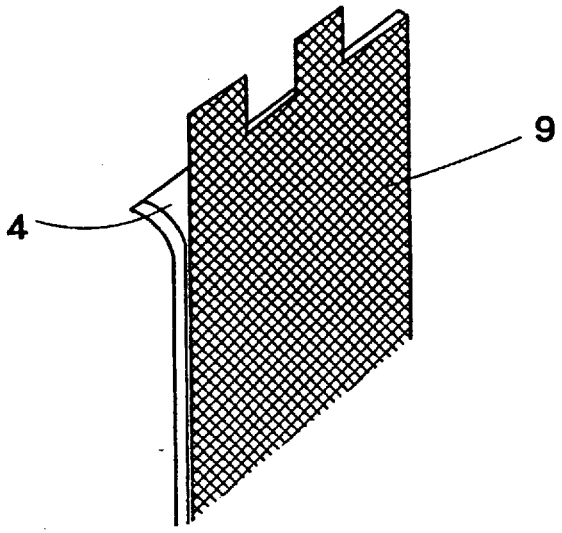
FIGS. 2(*a*) and 2(*b*) are a schematic illustrative of how to mount an active cathode in place by the active cathode-reactivating process according to the present invention.
Figure 2:
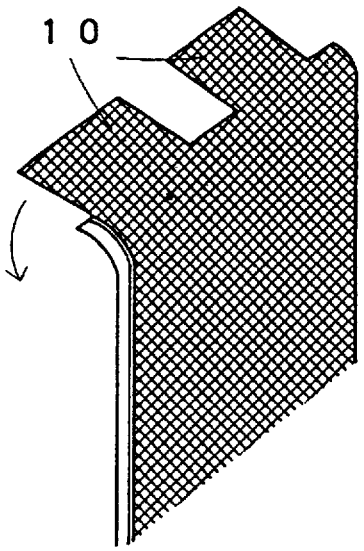

FIGS. 2(*a*) and 2(*b*) is a schematic illustrative of how to attach the active cathode in place according to the active cathode-reactivating process of the present invention. As depicted in FIG. 2(*a*), the active cathode 9 is placed on the porous cathode 4 with a decreased activity, so that mounting pieces 10 at one end of the active cathode is bent down for attachment on the porous cathode 4, as depicted in FIG. 2(*b*). In this case, the active cathode 9 is formed of a material that is smaller in wire diameter and is more easily bendable as compared with the porous cathode with a decreased activity, so that it can easily be attached on the surface of the cathode with a decreased activity.

Figure 3:
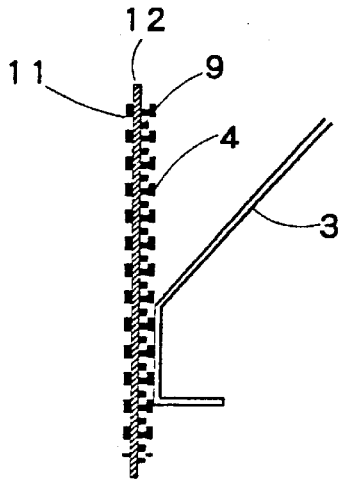
FIG. 3 is a sectional schematic illustrating an ion exchange membrane type electrolyzer having an active cathode reactivated by the active cathode-reactivating process according to the present invention.

FIG. 3 is a schematic illustrating an ion exchange membrane type electrolyzer having a cathode reactivated by the active cathode-reactivating process of the present invention.

Between the active cathode 9 of the present invention and an anode 11 there is located an ion exchange membrane 12, and the porous cathode 4 is bonded to the flexible member 3. In an ion exchange membrane type electrolyzer, the ion exchange membrane is generally pressed against an anode side due to an electrolyte and a gas pressure difference between a cathode chamber and an anode chamber. Accordingly, the cathode is pressed by the flexible member against the surface of the ion exchange membrane in contact with the anode to produce pressure, whereby the cathode having a decreased activity is brought into sufficient contact with the newly attached active cathode, so that electrically conductive connection can be made between the cathode having a decreased activity and the new active cathode.

As can be seen from FIG. 3, only the previously used cathode having a decreased activity is positioned on the side of the active cathode that is not opposite to the ion exchange membrane; any member that may make electrically conductive connection between them or fix them to each other is not provided. This ensures pores sufficient to allow gases to pass easily through the electrode portion, so that they can be immediately recovered. It is thus possible to avoid adverse influences such as a voltage rise due to the stagnation of produced gases.

According to the process of the present invention, the active cathode to be attached to an existing cathode having a decreased activity may be formed of an expanded metal that is smaller in wire and pore diameters than the material forming the existing cathode. Even when an unwoven or woven fabric form of fine metal wires is used, therefore, it is unlikely that the ion exchange membrane may be injured by the fine metal wires to form pinholes.

For the active cathode usable in the active cathode production process of the present invention, it is preferable to use an expanded metal having a porosity of at least 70% and a thickness of up to 0.4 mm, because an amount of hydrogen generated at the cathode can be immediately separated from the cathode. It is also preferable to use an expanded metal shaped such that when it is used in combination with an existing expanded metal, the number of portions of contact therewith increases so that its resistance of contact therewith can be minimized.

In accordance with the process of the present invention, a new active cathode is attached to the surface of the cathode having a decreased activity without removal of an electrode catalyst coating therefrom. It is thus possible to make sufficient conductive connection between the remaining cathodically active coating film and the newly attached active cathode because they are brought in sufficient contact with each other.

The present invention will now be explained with reference to non-limiting two examples.

EXAMPLE 1

Brine electrolysis was carried out in an ion exchange membrane type electrolyzer having an electrode size of 100 mm in length and 250 mm in breadth, which was provided by means of a comb form of flexible nickel member with a nickel cathode formed of a rolled flat expanded metal of 8.0 mm in major diameter, 3.7 mm in minor diameter, 0.9 mm in crimped width, and 0.8 mm in thickness. As a result, the activity of the nickel cathode dropped. A rolled nickel flat expanded metal having an electrode size of 100 mm in length and 250 mm in breadth, which was provided with a cathode of 4.4 mm in major diameter, 3.0 mm in minor diameter, 0.2 mm in crimped width and 0.2 mm in thickness, and with two mounting pieces on a longitudinal side of an peripheral portion thereof and three mounting pieces on a lateral side thereof, said pieces being 15×10 mm in size, was then nickel-plated in a plating bath containing 300 g/l of nickel chloride, 50 g/l of aluminum chloride, 38 g/l of boric acid, and 0.9 g/l of a nickel-aluminum alloy (50:50). Thereafter, the cathode was dipped in 20% by weight of sodium hydroxide at 75° C. for aluminum removal.

Then, the active cathode was dipped in an aqueous hydrogen peroxide solution adjusted to a concentration of 3 g/l and pH 12 for 10 minutes for its stabilization treatment.

With this cathode attached to the existing electrode by the bending of the mounting pieces, electrolysis was carried out at a current density of 4.0 kA/m$^2$ for 6 months. As a result, it was found that the electrolysis voltage does not exceed that measured before the deactivation of the cathode.

EXAMPLE 2

Eight expanded metal cathodes of 350 mm×1,170 mm in size, which was newly prepared according to Example 1, are attached on existing electrodes in two pairs of unit electrolyzer elements having an electrode area of 3.276 m$^2$, which was already operated for 2.5 years, by the bending of mounting pieces according to Example 1. After a three-month operation, no significant voltage increase was found.

With the active cathode-reactivating process according to the present invention, it is possible to reactivate an active cathode within a very short period of time, because an active cathode smaller in wire diameter and pore diameter than an existing cathode is attached on the surface of a cathode whose activity is decreased, so that it can be brought into contact with an ion exchange membrane by means of a flexible member attached to the active cathode to make electrically conductive connection with the existing cathode without removal of a cathode catalyst coating whose activity is decreased.

What we claim is:

1. A process for reactivating an active cathode attached to an electrolyzer, wherein a porous cathode that is attached to the electrolyzer by means of a flexible member and has a decreased electrode catalyst activity is provided thereon with a fresh active cathode equivalent to, or smaller in wire diameter or pore diameter than, said porous cathode by bending a mounting piece formed around said fresh active cathode without removal of an electrode catalyst substance from said porous cathode that is already deteriorated.

2. A process for reactivating an active cathode attached to an electrolyzer, comprising the steps of attaching a porous cathode to the electrolyzer by means of a flexible member, said porous cathode having a decreased electrode catalyst activity, providing said porous electrode with a fresh active cathode having a diameter equivalent to said porous cathode by bending a mounting piece formed around said fresh active cathode without removing an electrode catalyst substance from said porous cathode that is already deteriorated.

3. The process for reactivating an active cathode attached to an electrolyzer as in claim 2 wherein said diameter of said fresh active cathode is smaller in wire diameter than said porous cathode.

4. The process for reactivating an active cathode attached to an electrolyzer as in claim 2 wherein said diameter of said fresh active cathode is smaller in pore diameter than said porous cathode.

* * * * *